US007348692B2

(12) United States Patent
Chang et al.

(10) Patent No.: US 7,348,692 B2
(45) Date of Patent: Mar. 25, 2008

(54) LINEAR COMPRESSOR

(75) Inventors: Keun-sik Chang, Suwon (KR); Phil-soo Chang, Seongnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 537 days.

(21) Appl. No.: 10/816,928

(22) Filed: Apr. 5, 2004

(65) Prior Publication Data

US 2004/0258540 A1 Dec. 23, 2004

(30) Foreign Application Priority Data

Jun. 19, 2003 (KR) ..... 10-2003-0039679

(51) Int. Cl.
*H02K 33/00* (2006.01)

(52) U.S. Cl. ..... 310/12; 310/15

(58) Field of Classification Search ..... 310/12–15; 417/417

See application file for complete search history.

(56) References Cited

U.S. PATENT DOCUMENTS

| | | | | |
|---|---|---|---|---|
| 4,632,645 | A * | 12/1986 | Kawakami et al. | 417/417 |
| 4,864,176 | A | 9/1989 | Miller et al. | |
| 6,040,642 | A | 3/2000 | Ishiyama | |
| 6,060,810 | A | 5/2000 | Lee et al. | |
| 6,209,328 | B1 | 4/2001 | Kim et al. | |
| 6,238,192 | B1 | 5/2001 | Lee | |
| 6,881,042 | B2 * | 4/2005 | Heo et al. | 417/417 |
| 6,980,072 | B2 * | 12/2005 | Yumita et al. | 335/229 |
| 2004/0258543 | A1 * | 12/2004 | Kim | 417/417 |

FOREIGN PATENT DOCUMENTS

| | | | |
|---|---|---|---|
| CN | 1240883 | A | 1/2000 |
| JP | 09-209935 | | 8/1997 |
| JP | 2001-359269 | A | 12/2001 |
| JP | 2001-359270 | A | 12/2001 |
| JP | 2003-134787 | | 5/2003 |
| JP | 2003-143826 | | 5/2003 |
| KR | 1999-17222 | | 3/1999 |
| KR | 10-206768 | | 4/1999 |
| KR | 10-206831 | | 4/1999 |
| KR | 1999-48733 | | 7/1999 |
| KR | 10-230781 | | 8/1999 |
| KR | 10-246428 | | 12/1999 |

(Continued)

OTHER PUBLICATIONS

European Search Report for corresponding patent application No. 04250971.1-2315 dated Sep. 8, 2005.

(Continued)

*Primary Examiner*—Thanh Lam
(74) *Attorney, Agent, or Firm*—Staas & Halsey LLP

(57) ABSTRACT

A linear compressor comprises an external casing forming a compressing chamber, an outer core disposed in the external casing, an inner core assembly disposed inside of the outer core interacting with the outer core, and wherein the inner core assembly comprises an inner core, an upper cover combined to an upper part of the inner core, and a bottom supporting part combined to a bottom part of the inner core. With this configuration, the linear compressor provides a capability of simplifying an inner core assembly, thereby reducing the manufacturing cost.

24 Claims, 8 Drawing Sheets

FOREIGN PATENT DOCUMENTS

| | | | |
|---|---|---|---|
| KR | 10-253257 | | 1/2000 |
| KR | 2000-38800 | | 7/2000 |
| KR | 2001-0063935 | | 7/2001 |
| KR | 2002-0057428 | | 7/2002 |
| KR | 10-349709 | | 8/2002 |
| KR | 2002-64554 | | 8/2002 |
| KR | 10-390923 | | 6/2003 |
| WO | WO/0150574 | A2 | 12/2001 |

OTHER PUBLICATIONS

Korean Office Action for corresponding Korean Patent Application No. 10-2003-0039679 dated May 31, 2005.

Chinese Office Action for corresponding Application No. 200410005978.3 dated Aug. 25, 2006.

Japanese Office Action for Application No. 2004-107213 dated Jan. 9, 2007.

* cited by examiner

LINEAR COMPRESSOR

CROSS-REFERENCE TO RELATED APPLICATIONS

This application claims the benefit of Korean Patent Application No. 2003-39679, filed on Jun. 19, 2003, in the Korean Intellectual Property Office, the disclosure of which is incorporated herein by reference.

BACKGROUND OF THE INVENTION

1. Field of the Invention

The present invention relates to a linear compressor and more particularly a linear compressor having an improved assembling structure of an inner core assembly.

2. Description of the Related Art

In general, a conventional linear compressor comprises a casing, a mover provided in the casing and reciprocating by an interaction of an inner core and an outer core, a compressing part compressing and discharging a refrigerant, and a linear motor generating a, driving force of the inner and outer cores.

The conventional linear compressor operates in the following sequence.

When power is supplied to the compressor while the compressor is in a stop state, current is applied to winding coils at an opening part of the outer core, thereby generating a rotational magnetic flux at the inner core and the outer core. The magnetic flux interacts with a magnetic field formed by a magnet to reciprocate a piston, and thereby suctioning and discharging the refrigerant after compressing.

Korean Patent No. 0374837 discloses a linear motor for such a conventional compressor comprising a stator having an outer core and a cylindrical inner core inserted into the outer core, winding coils combined into the inner core or the outer core, and a mover movably inserted between the outer core and the inner core having a permanent magnet provided therein.

The outer core includes a plurality of lamination sheets incorporated into a laminated unit, and is combined to an annular bobbin having coils wounded by an injection-molded insulator.

However, it is necessary that the inner core and the outer core provided as a laminated unit are firmly mounted with a simple structure and an easy installation, and thereby reducing the manufacturing costs of the conventional linear motor.

Also, it is necessary to prevent a decrease in the efficiency of the linear motor due to an eddy current loss generated when material having low electrical resistivity for the inner core of the conventional linear motor.

SUMMARY OF THE INVENTION

Accordingly, it is an aspect of the present invention to provide a linear compressor which is capable of simplifying an inner core assembly, thereby reducing the manufacturing cost.

Additional aspects and advantages of the invention will be set forth in part in the description which follows, and in part, will be obvious from the description, or may be learned by practice of the invention.

The foregoing and/or other aspects of the present invention are achieved by providing a linear compressor comprising an external casing forming a compressing chamber, an outer core disposed in the external casing, an inner core assembly disposed inside of the outer core interacting with the outer core, wherein the inner core assembly comprising an inner core, an upper cover combined to an upper part of the inner core, and a bottom supporting part combined to a bottom part of the inner core.

According to an aspect of the invention, the inner core comprising a plurality of core blocks provided by stacking a plurality of core steel plates made by punching thin steel plates, wherein the plurality of core blocks are circumferentially arranged around the inner core at regular intervals.

According to an aspect of the invention, each core steel plate comprising an upper hook in an upper part thereof, and a bottom hook in a bottom part, and the upper cover comprising an upper recess to engage with the upper hook and the bottom supporting part comprising a bottom recess to engage with the bottom hook.

According to an aspect of the invention, the upper cover and the bottom supporting part are connected to each other by a connection member, which stands erect toward the bottom supporting part.

According to an aspect of the invention, the connection member comprising a bolt or a rivet disposed between the plurality of core blocks.

According to an aspect of the invention, the upper cover and the bottom supporting part are provided as a single unit, and the plurality of core blocks have connection supporting parts standing erect toward the bottom supporting part between the core blocks, forming a single unit with the upper cover and the bottom supporting part.

According to an aspect of the invention, the inner core is made by stacking a plurality of core steel plates made by punching thin steel plates.

According to an aspect of the invention, the upper part of each of the core steel plates comprising an upper hook protruding upward, and the bottom supporting part of each of the core steel plates has a bottom hook protruding downward, and the upper cover comprising an upper recess to engage with the upper hook and the bottom supporting part has a bottom recess to engage with the bottom hook, wherein an area where the upper hook is engaged with the upper recess, and an area where the bottom hook is engaged with the bottom recess are welded to each other.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
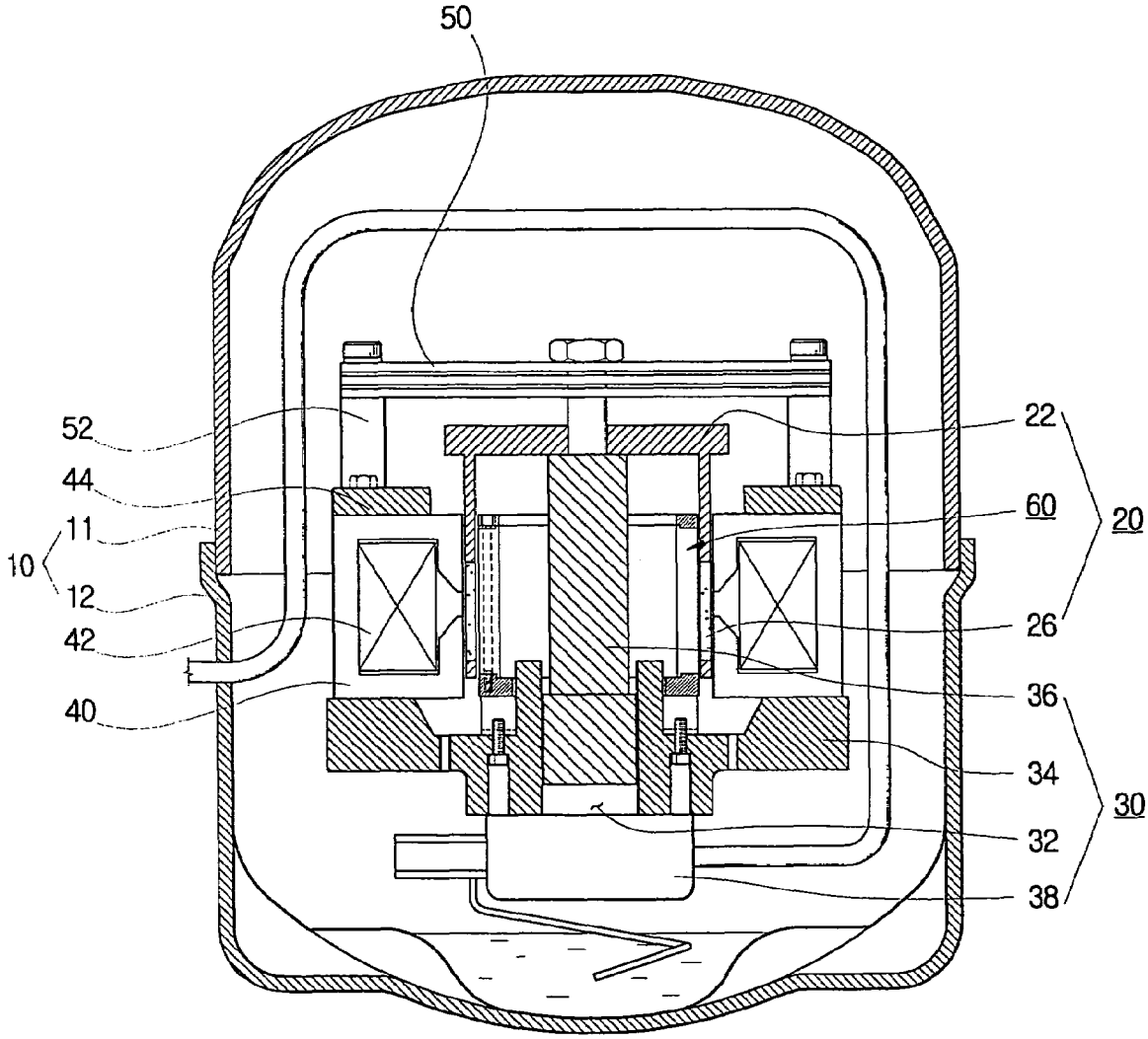
FIG. 1 is a sectional view of a linear compressor according to a first embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

In FIG. 1, a linear compressor according to a first embodiment of the present invention comprising an external casing 10, a mover 20 provided in the external casing 10 and reciprocating by an interaction of an outer core 40 (to be described later) and an inner core 61 (to be described later), and a compressing part 30 suctioning and discharging the refrigerant after compressing.

The external casing 10 is closed to the outside with an upper casing 11 and a bottom casing 12 welded to each other at an end of the upper casing 11 and an end of the bottom casing 12. In FIG. 1, the end of the bottom casing 12 is welded on the end of the upper casing 11.

The mover 20 comprising a main frame 22, an inner core assembly 60 disposed inside the main frame 22, and a cylinder-shaped magnet 26 disposed in an opening of the inner core assembly 60. An inner core 61 of the inner core assembly 60 is radially disposed to the inner circumference of the main frame 22.

Figure 2:
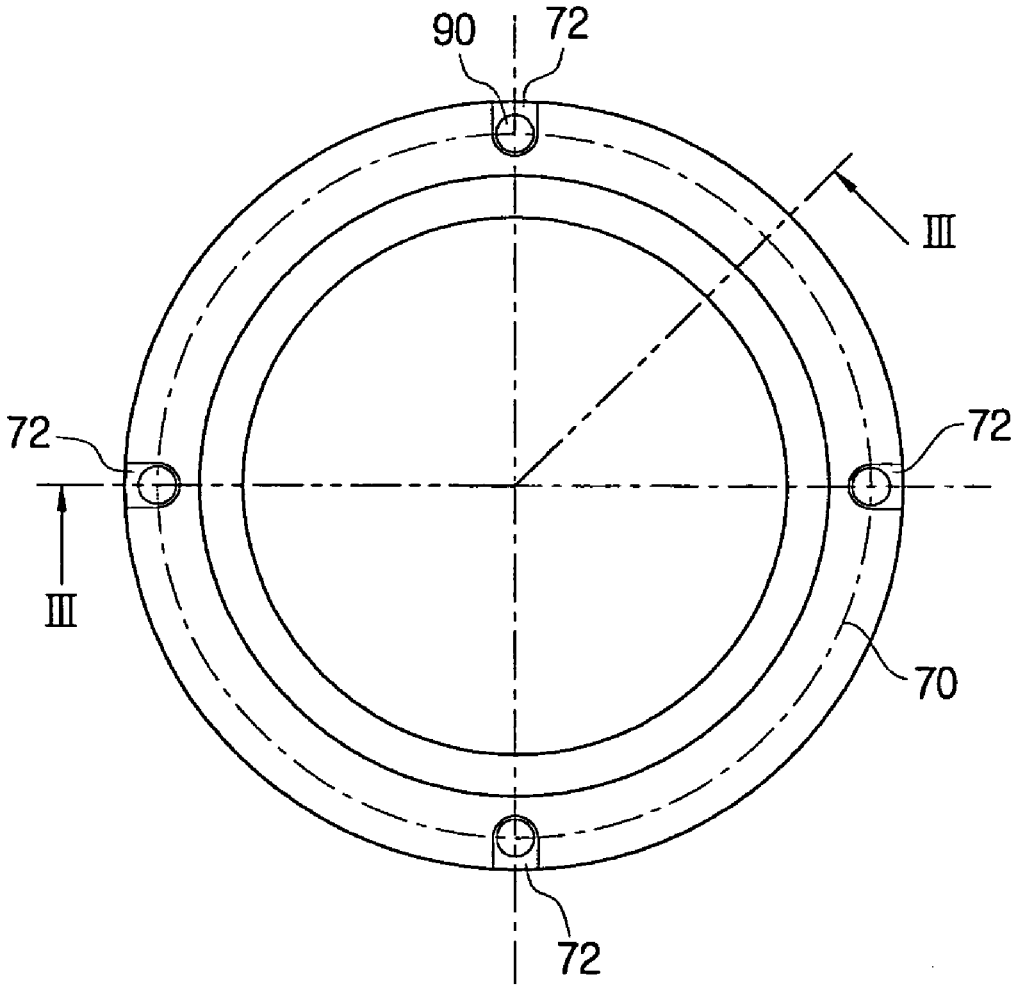
FIG. 2 is a plan view of an inner core assembly of the linear compressor of FIG. 1.
Figure 3:
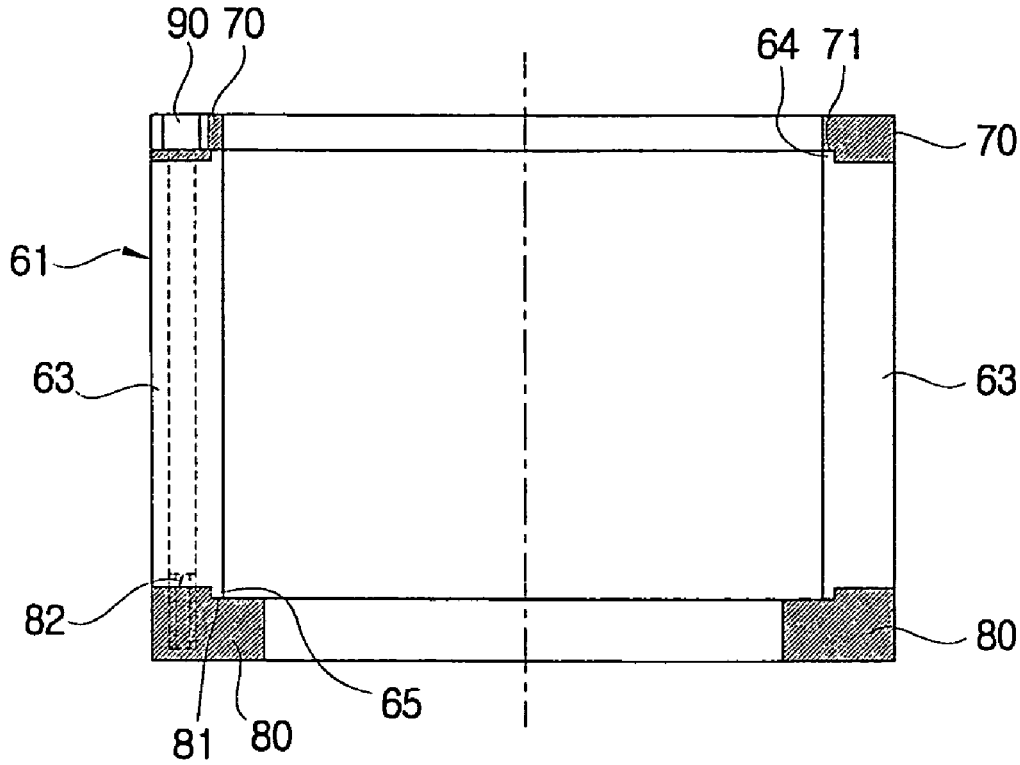
FIG. 3 a sectional view of the inner core assembly, taken along a line III-III of FIG. 2.
Figure 4:
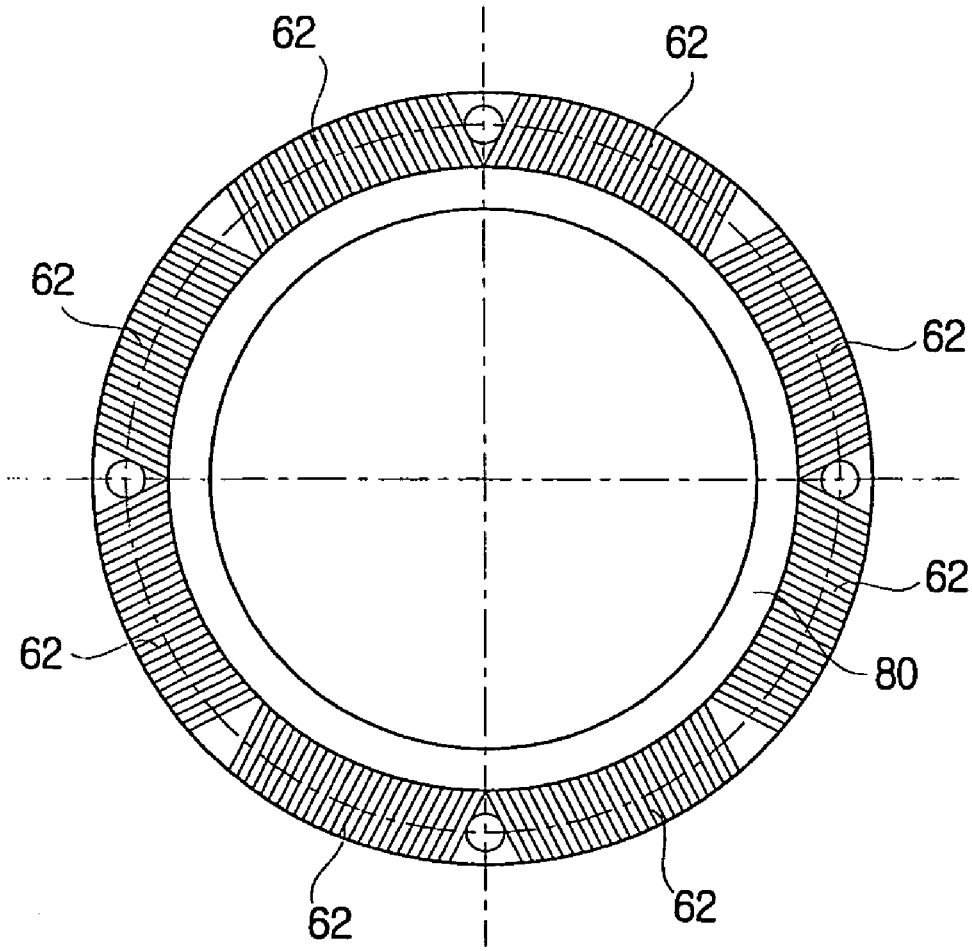
FIG. 4 is a plan view of the inner core assembly shown in FIG. 2, without an upper cover.

In FIGS. 2-4, the inner core assembly 60 has the cylinder-shaped inner core 61, an upper cover 70 combined to an upper side of the inner core 61, a bottom supporting part 80 combined to a bottom of the inner core 61. The upper cover 70 is combined with the bottom supporting part 80 by at least one connection member 90. The inner core 61 comprising a plurality of core blocks 62 radially arranged at regular intervals to form a cylinder shape. Each of the core blocks 62 is formed by stacking a plurality of core steel plates 63 made by punching a thin steel plate and welding the stack of core steel plates 63.

In upper parts of the plurality of core steel plates 63 forming the core blocks 62, upper hooks 64 are protruded upward to be combined to the upper cover 70, and bottom hooks 65 are protruded downward to be combined to the bottom supporting part 80 in a bottom of the plurality of core steel plates 63.

An upper recess 71 is formed in an upper part of the inner core 61 to engage with the upper hooks 64, to combine the upper cover 70 to the upper part of the inner core 61. Thus, the upper cover 70 can support the upper part of the inner core 61.

In the upper cover 70, a plurality of first connecting holes 72 are circumferentially arranged around the inner core 61.

A bottom recess 81 is formed in a bottom of the inner core 61 engaged with the bottom hooks 65 and to combine the bottom supporting part 80 to the bottom of the inner core 61.

In the bottom supporting part 80, a plurality of second connecting holes 82 are circumferentially arranged around the inner core 61 wherein the connection member 90 connecting the upper cover 70 and the bottom supporting part 80 is engaged.

The connection member 90 comprising a bolt or a rivet, and passing through the first connecting hole 72 of the upper cover 70 and through a space formed between the plurality of core blocks 62, and is then inserted into the second connecting hole 82 of the bottom supporting part 80. Thus, the upper cover 70 and the bottom supporting part 80 are stably connected. Here, the connection member 90 is vertically positioned to the bottom supporting part 80.

In FIG. 1 the compressing part 30 comprising a cylinder block 34 forming a compressing chamber 32 while supporting a bottom of the outer core 40, a piston 36 reciprocating in the compressing chamber 32, and a cylinder head 38 provided in a bottom area of the cylinder block 34 and having valves for a refrigerant.

The cylinder-shaped outer core 40 is provided on an outside the mover 20, with a predetermined gap relative to the magnet 26. An opening of the outer core 40 comprising a plurality of core steel plates (not shown) stacked each having annular coils 42 therein.

The outer core 40 comprising a bottom part supported by the cylinder block 34 and an upper part supported by a supporting block 44. On an upper part of the supporting block 44, a resonant spring (not shown) accelerating the reciprocating movement of the piston 36 is combined by a plurality of shaft members 52.

The linear compressor according to the present invention is operated as follows.

When power is supplied to the linear compressor in a stop state, current is applied to the coils 42 in the opening of the outer core 40. Then, a rotational magnetic flux is generated in the outer core 40 and the inner core 61 to thereby generate magnetic flux to interact with a magnetic field of the magnet 26. Thus, the piston reciprocates up and down so as to suction, compress and discharge the refrigerant of the compressing chamber 32.

Figure 5:
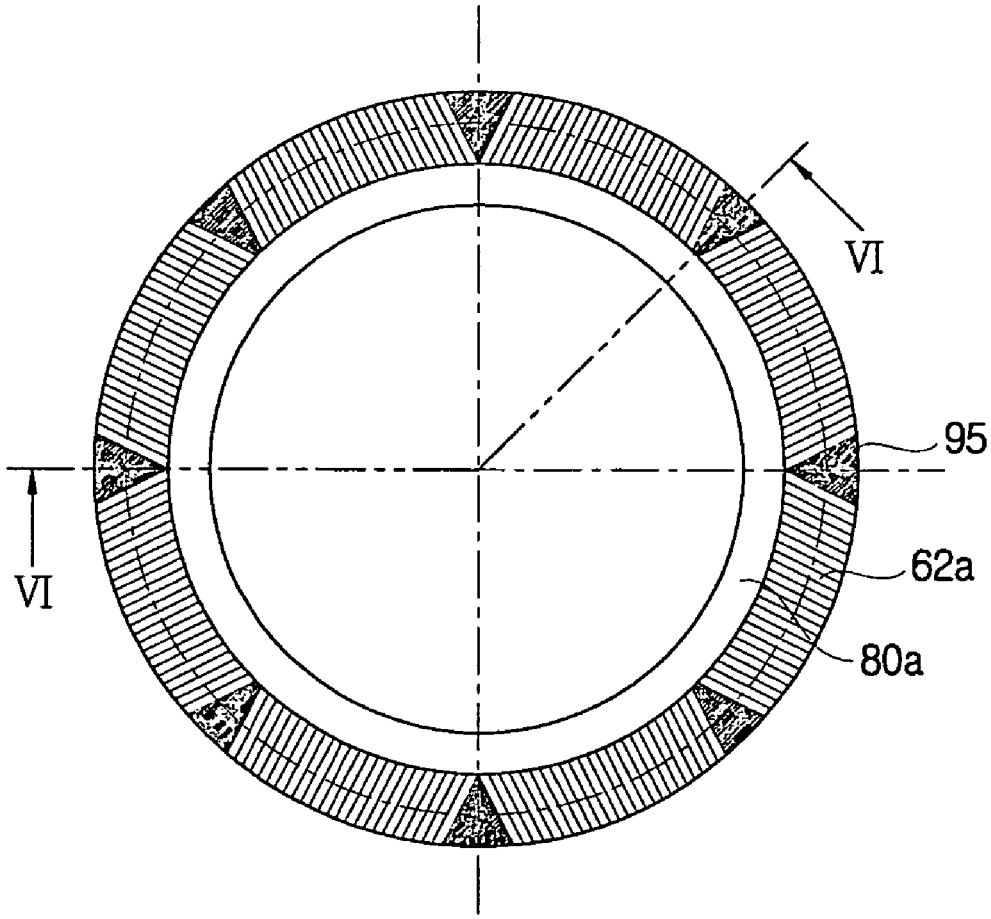
FIG. 5 is a plan view of the inner core assembly according to a second embodiment of the present invention.
Figure 6:
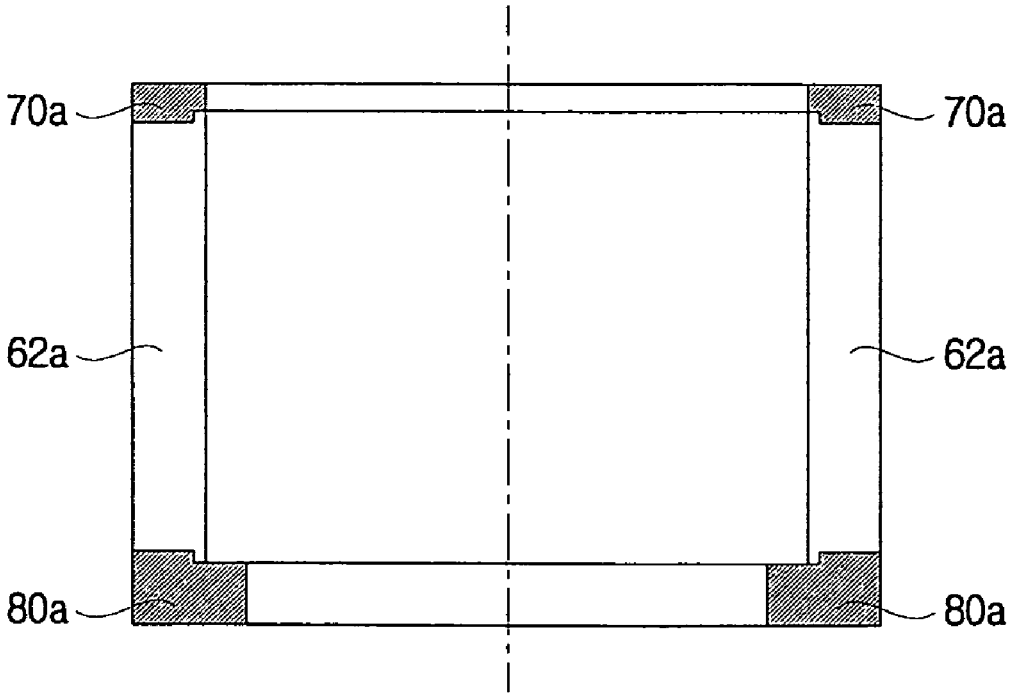
FIG. 6 is a sectional view of an inner core assembly, taken along a line VI-VI of FIG. 5.

According to the first embodiment of the present invention, the upper cover 70 and the bottom supporting part 80 are individually provided and connected to each other by at least one connection member 90. According to a second embodiment as shown in FIGS. 5 and 6, the upper cover 70 and the bottom supporting part 80 is provided as a single unit by injection molding of resin or die casting of aluminum. Accordingly, unlike the connection member 90 provided between the plurality of the core blocks 62 according to the first embodiment of the present invention, connection supporting parts 95 are provided between the plurality of the core blocks 62*a* in a vertical direction to a bottom supporting part 80*a* as shown in FIG. 5, forming a single unit with an upper cover 70*a* and the bottom supporting part 80*a*.

Figure 7:
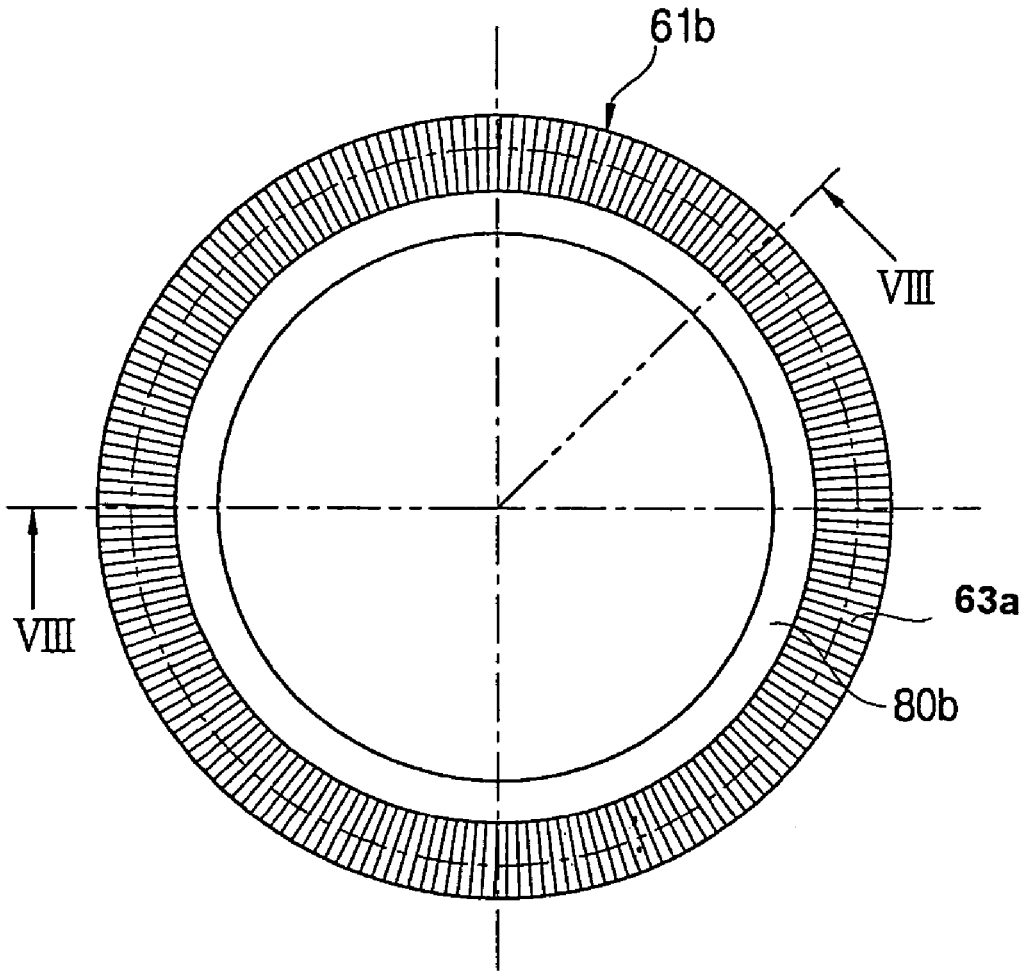
FIG. 7 is a plan view of an inner core assembly according to a third embodiment of the present invention.
Figure 8:
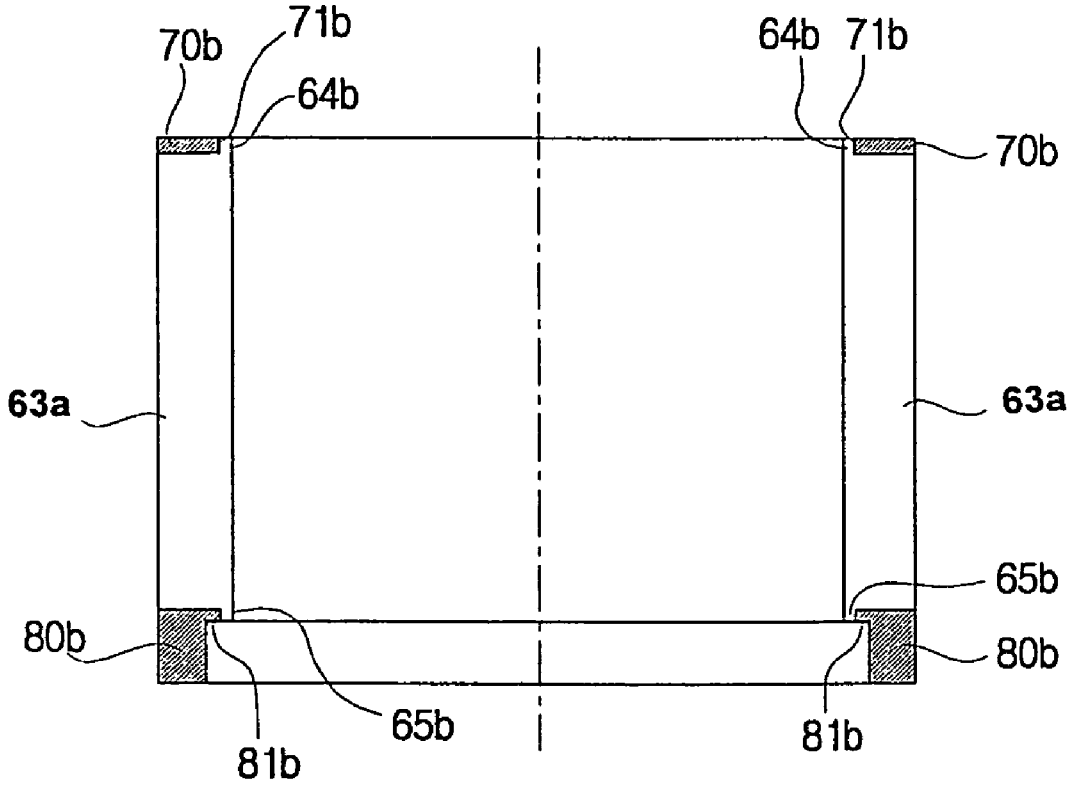
FIG. 8 is a sectional view of the inner core assembly, taken along a line VIII-VIII of FIG. 7.

The inner core 61*a* comprises the plurality of core blocks 62 and 62*a* according to the first and the second embodiments of the present invention. In FIGS. 7 and 8, an inner core 61*b* can be made by radially stacking core steel plates 63*a* made by punching thin steel plates with an upper cover 70*b* combined to an upper part of the inner core 61*b* and a bottom supporting part 80*b* combined to a bottom part thereof. That is, as parts of the inner core 61*b*, an upper hook 64*b* formed in the plurality of core steel plates 63*a* and an upper recess 71*b* of the upper cover 70*b* are engaged to each other, and thus the upper cover 70*b* is connected to the upper part of the inner core 61*b*, and a bottom hook 65*b* formed in a plurality of the core steel plates 63*a* and a bottom recess 81*b* are engaged to each other, so that the bottom supporting part 80*b* is connected to the bottom part of the inner core 61*b*.

According to a third embodiment of the present invention, connecting areas of the upper hook 64*b* and the upper recess 71*b* and of the bottom hook 65*b* and the bottom recess 81*b* are respectively welded, unlike the first and second embodiments.

In the linear compressor according to the third embodiment of the present invention, the inner core assembly can be manufactured simply, thereby decreasing the manufacturing cost.

Also, the inner core assembly with such an assembling structure minimizes eddy current, thereby increasing the efficiency of the linear motor.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A linear compressor comprising:

an external casing forming a compressing chamber;

an outer core disposed in the external casing;

an inner core assembly disposed inside of the outer core interacting with the outer core wherein the inner core assembly comprising:

an inner core, an upper cover combined to an upper part of the inner core, a bottom supporting part combined to a bottom part of the inner core, and at least one connection member passing through the inner core, to connect the upper cover with the bottom supporting part.

2. The linear compressor of claim 1, wherein the inner core comprising a plurality of core blocks provided by stacking a plurality of core steel plates made by punching thin steel plates, and the plurality of core blocks are circumferentially arranged around the inner core at regular intervals.

3. The linear compressor of claim 2, wherein each of the core steel plates comprising:

an upper hook in an upper part thereof, and a bottom hook in a bottom part thereof; and the upper cover comprising an upper recess to engage with the upper hook; and the bottom supporting part comprising a bottom recess to be engaged to the bottom hook.

4. The linear compressor of to claim 3, the at least one connection member stands erect toward the bottom supporting part.

5. The linear compressor of claim 4, wherein the at least one connection member comprising a bolt or a rivet disposed between the plurality of core blocks.

6. The linear compressor of claim 3, wherein the upper cover and the bottom supporting part are provided as a single unit, and the plurality of core blocks comprising connection supporting parts standing erect toward the bottom supporting part between the core blocks, forming a single unit with the upper cover and the bottom supporting part.

7. The linear compressor of claim 1, wherein the inner core is made by stacking a plurality of core steel plates made by punching thin steel plates.

8. The linear compressor of claim 7, wherein the upper part of each of the core steel plates comprising an upper hook protruding upward, and the bottom supporting part of each of the core steel plates comprising a bottom hook protruding downward, and the upper cover has an upper recess to engage with the upper hook and the bottom supporting part comprising a bottom recess to engage with the bottom hook, and wherein an area where the upper hook is engaged with the upper recess, and an area where the bottom hook is engaged with the bottom recess are welded to each other.

9. The linear compressor of claim 1, wherein the external casing is closed to an outside with an upper casing and a bottom casing welded to each other at an end of the upper casing and an end of the bottom casing.

10. The linear compressor of claim 6, wherein the upper cover and the bottom supporting part are provided as the single unit by injection molding.

11. A linear compressor comprising:

an external casing forming a compressing part;

a mover provided in the external casing and comprising:

a main frame, an inner core assembly disposed inside of the main frame and comprising:

an inner core, an upper cover combined to an upper part of the inner core, a bottom supporting part combined to a bottom of the inner core, a magnet disposed in an opening of the inner core assembly, and at least one connection member passing through the inner core, to connect the upper cover with the bottom supporting part; and an outer core disposed in the external casing.

12. The linear compressor of claim 11, wherein the inner core is cylinder-shaped.

13. The linear compressor of claim 11, wherein the inner core comprising a plurality of core blocks radially arranged at regular intervals.

14. The linear compressor of claim 13, wherein each of the core blocks is formed by stacking a plurality of core steel plates made by punching a thin steel plate and welding the plurality of core steel plates.

15. The linear compressor of claim 14, further comprising:

upper hooks protruding upward and combining to the upper cover; and bottom hooks protruding downward and combining to the bottom supporting part in a bottom of the plurality of core steel plates.

16. The linear compressor of claim 15, further comprising an upper recess formed in an upper part of the inner core engaged with the upper hooks to combine the upper cover to the upper part of the inner core.

17. The linear compressor of claim 11, wherein the upper cover comprising a plurality of first connecting holes circumferentially arranged around the inner core.

18. The linear compressor of claim 15, further comprising a bottom recess in a bottom of the inner core engaged with the bottom hooks to combine the bottom supporting part to the bottom of the inner core.

19. The linear compressor of claim 17, wherein the bottom supporting part further comprising a plurality of second connecting holes circumferentially arranged around the inner core, wherein the at least one connection member connecting the upper cover and the bottom supporting part is engaged.

20. The linear compressor of claim 19, wherein the at least one connection member comprising a bolt or a rivet and passing through the first connecting hole of the upper cover and through a space formed between the plurality of core blocks and is then inserted into the second connecting hole of the bottom supporting part.

21. The linear compressor of claim 11, wherein the at least one connection member is vertically positioned to the bottom supporting part.

22. The linear compressor of claim 11, wherein the compressing part comprising:

a cylinder block forming a compressing chamber while supporting a bottom of the outer core;

a piston reciprocating in the compressing chamber; and a cylinder head provided in a bottom of the cylinder block and having valves for a refrigerant.

23. The linear compressor of claim 22, wherein the outer core is provided on an outside of the mover with a predetermined gap relative to the magnet.

24. The linear compressor of claim 23, wherein the outer core further comprising a plurality of core steel plates having annular coils therein.

* * * * *